US006829446B2

(12) United States Patent
Toizumi et al.

(10) Patent No.: US 6,829,446 B2
(45) Date of Patent: Dec. 7, 2004

(54) DEVELOPMENT DEVICE, CHARGING METHOD USED IN THE DEVELOPMENT DEVICE AND IMAGE FORMING DEVICE HAVING THE DEVELOPMENT DEVICE

(75) Inventors: Kiyoshi Toizumi, Nara (JP); Taisuke Kamimura, Kitakatsuragi-gun (JP); Toshimitsu Gotoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/427,654

(22) Filed: Apr. 30, 2003

(65) Prior Publication Data

US 2003/0210918 A1 Nov. 13, 2003

(30) Foreign Application Priority Data

May 1, 2002 (JP) ..... 2002-129704

(51) Int. Cl.[7] ..... G03G 15/08

(52) U.S. Cl. ..... 399/53; 399/55; 399/284; 399/285

(58) Field of Search ..... 399/38, 53, 55, 399/252, 265, 279, 281, 284, 285; 430/120; 361/225

(56) References Cited

U.S. PATENT DOCUMENTS 6,438,346 B2 8/2002 Kamimura et al. ..... 399/281
6,600,892 B2 * 7/2003 Kamimura et al. ..... 399/281
2002/0141790 A1 10/2002 Kamimura et al. ..... 399/279

FOREIGN PATENT DOCUMENTS

JP 07-281473 10/1995

* cited by examiner

*Primary Examiner*—Hoan Tran
(74) *Attorney, Agent, or Firm*—David G. Conlin, Esq.; John J. Penny, Jr.; Edwards & Angell, LLP

(57) ABSTRACT

An image forming device includes a development section which has a blade for applying electrons generated in its photoelectric surface due to a photoelectric effect to a toner so as to charge the toner; an ultraviolet irradiator for irradiating the photoelectric surface with light; a development roller for holding the toner thus charged, and performing carriage of the toner to a photoconductive drum having an electrostatic latent image on a surface; wherein the electrostatic latent image on the photoconductive drum is developed by the charged toner. The development section further includes a control section for performing control of application of a voltage to the ultraviolet irradiator, application of a voltage to the photoelectric surface, application of a voltage to the development roller, and beginning of the carriage of the toner by the development roller, at predetermined timings, respectively.

36 Claims, 5 Drawing Sheets

DEVELOPMENT DEVICE, CHARGING METHOD USED IN THE DEVELOPMENT DEVICE AND IMAGE FORMING DEVICE HAVING THE DEVELOPMENT DEVICE

FIELD OF THE INVENTION

The present invention relates to a development device used for an electrophotography type image forming device, such as a photocopier, a printer, and a facsimile device; and a charging method used in the development device; and an image forming device having the development device.

BACKGROUND OF THE INVENTION

An electrophotography type image forming device (electrophotography device), such as a photocopier, a printer, or a facsimile device generally includes a LSU (Laser beam Scanner Unit), a photoconductive drum, and a development device. Here, the LSU irradiates a rotating photoconductive drum with a laser-beam so as to form an electrostatic latent image on a surface of the photoconductive drum. Then, the development device further supplies toner to the photoconductive drum so as to develop (visualize) the electrostatic latent image.

Further, the development device includes a development roller provided to be adjacent and opposite to the photoconductive drum. The development device uses, for example, a feed roller (toner feeding roller) for supplying toner on a surface of the development roller, and rotates the development roller, so as to sequentially supply the toner to all of the electrostatic latent images on the photoconductive drum.

Incidentally, in such a development device, the electrostatic latent image on the photoconductive drum absorbs the toner due to electrostatic force so as to carry out development. Therefore, it is required to charge the toner by some methods.

For example, in case of a development device using nonmagnetic toner of one-component system for development of an electrostatic latent image, the toner is sequentially supplied to the surface of a development roller by a feed roller in the circumferential direction, while the toner is held and carried by rotation of the development roller. Also, the thickness of the toner is controlled by a thickness control blade, which is provided downstream of the feed roller in the rotation direction of the development roller, while the toner is charged due to friction with the thickness control blade (friction charging).

The toner is held in this state until carried to an opposite portion to a photoconductor. The portion is provided further downstream in the rotation direction of the development roller. Then, the toner is supplied to an electrostatic latent image on the surface of the photoconductor due to electrostatic force. As a result, the electrostatic latent image is developed (visualized) as a toner image.

Note that, the developer used in the development device may be a one-component type magnetic toner containing magnetic powder, or a two-component type developer in which the toner is mixed with a carrier.

In this manner, the toner is charged by friction with the blade while its thickness is controlled by the blade applied to the development roller with a great pressure (F).

Considering this arrangement in terms of the energy budget, driving energy (Ek) supplied to the development roller is converted to toner thickness control energy (Es) and toner charging energy (Et). Also, the driving energy is partly consumed as heat loss energy (E1).

Namely, the following equation (1) is satisfied as the basic equation of the energy budget in such a friction charging method.

$$Ek=Es+Et+E1 \quad (1)$$

The heat loss energy (E1) generated by such a friction charging brings about such as destruction of toner, fusion of softened toner into the surface of the blade. This further causes degradation of friction charging property between the toner and the surface of the blade.

Further, in recent years, as one of energy saving technologies, melioration of toner has been in progress. For example, the softening point of toner is decreased for reduction of fixing energy, also the number of pigments of toner is increased for an improvement of coloring property.

However, as described, the foregoing friction charging method performing control of the thickness of the toner and the charging of the toner at the same time is carried out with a great thermal load, and therefore the foregoing improved toner cannot be used for the method. In this regard, a charging method with a small thermal load has been required in order to cope with the improved toner.

Further, the relation between the heat loss energy (E1) and the applied pressure (F) satisfies the following equation (2) where C1 is a proportional constant.

$$\text{heat loss energy } (E1)=C1\times\text{pressure } (F) \quad (2)$$

According to this equation (2), it is effective to decrease the applied pressure for reducing the thermal load with respect to the toner.

Further, the driving energy (Ek) of the development roller satisfies the following equation (3) where C2 is a proportional constant.

$$\text{driving energy } (Ek)=C2\times\text{pressure } (F) \quad (3)$$

According to the foregoing equations (1) through (3), the applied pressure (F) satisfies the following equations (4).

$$C2\times F=Es+Et+C1\times F$$

$$(C2-C1)\times F=Es+Et \quad (4)$$

The equations revealed that, in order to realize pressure reduction, it is effective to use the method in which the toner charging energy (Et) does not rely on the applied pressure (F).

Then, the blade of friction charging method is here set to separately performs the toner thickness control function and the toner charging function. More specifically, the applied pressure (F) is mainly used as the toner thickness control energy (Es), while the toner charging energy (Et) relies on light energy instead of the pressure (F).

In such a case, the thermal load can be reduced and therefore, it is possible to prevent destruction of the toner, i.e., degradation of the toner, or fusion of the toner into the blade. Thus, reliability of the development operation can be increased. Further, this charging method may also be used with the improved toner which is for realizing reduction of fixing energy or improvement of coloring ability.

Further, as one example of the charging method using light energy, Japanese Laid-Open Patent Application Tokukaihei 07-281473/1995 (published on Oct. 27, 1995) discloses a toner charging method which controls the toner charging quantity by irradiating the toner with light in a developer tank after including a photochromic compound in the toner.

However, in such a charging method using light energy, assuming that all of the members in the development device are turned on, the toner is not thoroughly charged at the time that the light irradiation has just been started, i.e., the toner carriage has just been started.

In this case, the toner, which is still in an uncharged state, is carried to a latent image holding body by a carriage section. This causes adherence of the uncharged toner to the electrostatic latent image or scatter of the toner inside of the device. As a result, some blank spots appear on the image, or the image becomes unfocused, thus decreasing printing quality.

Further, in the configuration of the Japanese Laid-Open Patent Application Tokukaihei 07-281473/1995, which uses light energy, the irradiation of the toner is carried out in the developer tank, thus failing to ensure stability of the toner charging.

Further, even when the toner on the toner carriage section (developer carriage section) is irradiated outside of the developer tank, i.e., when electrons are applied to the toner by using photoelectric effect of a photoelectron emitting section, the toner may not be sufficiently charged at the time that the toner carriage has just been started, and therefore the uncharged toner adheres to the surface of the photoelectron emitting section, thereby decreasing toner charging property of the surface of the photoelectron emitting section.

SUMMARY OF THE INVENTION

The present invention is made in view of the foregoing conventional problems, and an object is to provide a development device with a small thermal load with respect to the developer, and capable of stably charging the developer even immediately after the beginning of the carriage of developer by a developer carriage section, and also a charging method used in the development device, and an image forming device including the development device.

In order to solve the foregoing problems, a development device according to the present invention includes: a charging section having an electron emission section for applying electrons generated in the electron emission section due to a photoelectric effect to a developer so as to charge the developer; an irradiation section for irradiating the electron emission section with light so as to cause the electron emission section to generate the electrons; a developer carriage section for holding the developer thus charged, and performing carriage of the developer to a latent image holding body having an electrostatic latent image on a surface; and a control section for performing control of (a) application of a voltage to the irradiation section, (b) application of a voltage to the electron emission section, (c) application of a voltage to the developer carriage section, and (d) beginning of the carriage of the developer by the developer carriage section, at predetermined timings, respectively, the electrostatic latent image on the latent image holding body being developed by the developer which has been charged.

Generally, in a charging method using photoelectric effect, when all members of the development device (at least including the irradiation section, the electron emission section, and the developer carriage section) are turned on at the same time, the developer cannot be sufficiently charged immediately after the irradiation from the irradiation section, i.e., immediately after the beginning of the carriage of developer by the developer carriage section. Namely, the carriage of developer is started immediately after the image forming request even though the electrons in the electron emission section have not been sufficiently induced. As a result, the uncharged developer is carried by the developer carriage section.

As with the foregoing example, in the presence of the uncharged developer on the developer carriage section, the developer may be charged apparently in a reverse polarity due to contact and friction between the developer in the process of the carriage. More specifically, proper charging may be interfered by the peripheral developer. The developer charged in a reverse polarity gravitates toward the electron emission section and further adheres to the electron emission section. When the developer adheres to the electron emission section due to such a phenomenon, the adhering developer interferes the emission of the electrons in the electron emission section, thus decreasing developer charging ability in the electron emission section. As a result, charging of the carried developer becomes unstable.

Further, if the developer, which is still in an uncharged state, is carried to the latent image holding body by the developer carriage section, there arises adherence of the uncharged developer to the electrostatic latent image or scatter of the developer inside of the image forming device including the development device. As a result, blank spots appear on the image, or the image becomes unfocused, thereby decreasing printing quality.

However, according to the foregoing configuration, the control section controls the application of a voltage to the irradiation section, the application of a voltage to the electron emission section, the application of a voltage to the developer carriage section, and the beginning of carriage of the developer by the developer carriage section, at predetermined timings, thus stably charging the developer to be a desirable quantity even immediately after the beginning of the carriage of developer.

As a result, it is possible to prevent the decrease of charging ability in the electron emission section, thus stabilizing the charging of the carried developer.

Further, for example, the developer will not scatter inside of the image forming device having the development device, thus preventing the decrease of printing quality due to the blank spots on the image or the unfocused printing.

Since the developer is charged by using photoelectric effect, the thermal load with respect to the developer can be reduced. Therefore, it is possible to prevent destruction of the developer, or fusion of the developer into the charging section. Further, the development device can accept the use of improved developer which is made for realizing reduction of fixing energy or improvement of coloring ability.

In order to solve the foregoing problems, a charging method according to the present invention includes the step of: carrying out image forming by supplying the developer, which has been charged, to a latent image holding body having the electrostatic latent image on a surface, and transferring the developer image from the latent image holding body to a recording medium, wherein: (a) application of a voltage to an irradiation section which performs light irradiation, (b) application of a voltage to an electron emission section which induces electrons thereof by a photoelectric effect with the light irradiation, so as to discharge the electrons, (c) application of a voltage to a developer carriage section which performs carriage of the developer to the latent image holding body having the electrostatic latent image on the surface, and (d) beginning of the carriage of the developer by the developer carriage section, are carried out at predetermined timings, respectively.

According to the foregoing method, the application of a voltage to the irradiation section, the application of a voltage to the electron emission section, the application of a voltage to the developer carriage section, and the beginning of carriage of the developer by the developer carriage section, are controlled at predetermined timings, thus stably charging the developer to be a desirable quantity even immediately after the beginning of the carriage of developer, thus stabilizing the charging of the carried developer.

Further, for example, when using the foregoing charging method in an image forming device, the developer will not scatter inside of the image forming device, thus preventing the decrease of printing quality due to the blank spots on the image or the unfocused printing.

Additional objects, features, and strengths of the present invention will be made clear by the description below. Further, the advantages of the present invention will be evident from the following explanation in reference to the drawings.

DESCRIPTION OF THE EMBODIMENTS

The following will explain one embodiment of the present invention with reference to FIGS. 1 through 5.

Figure 1:
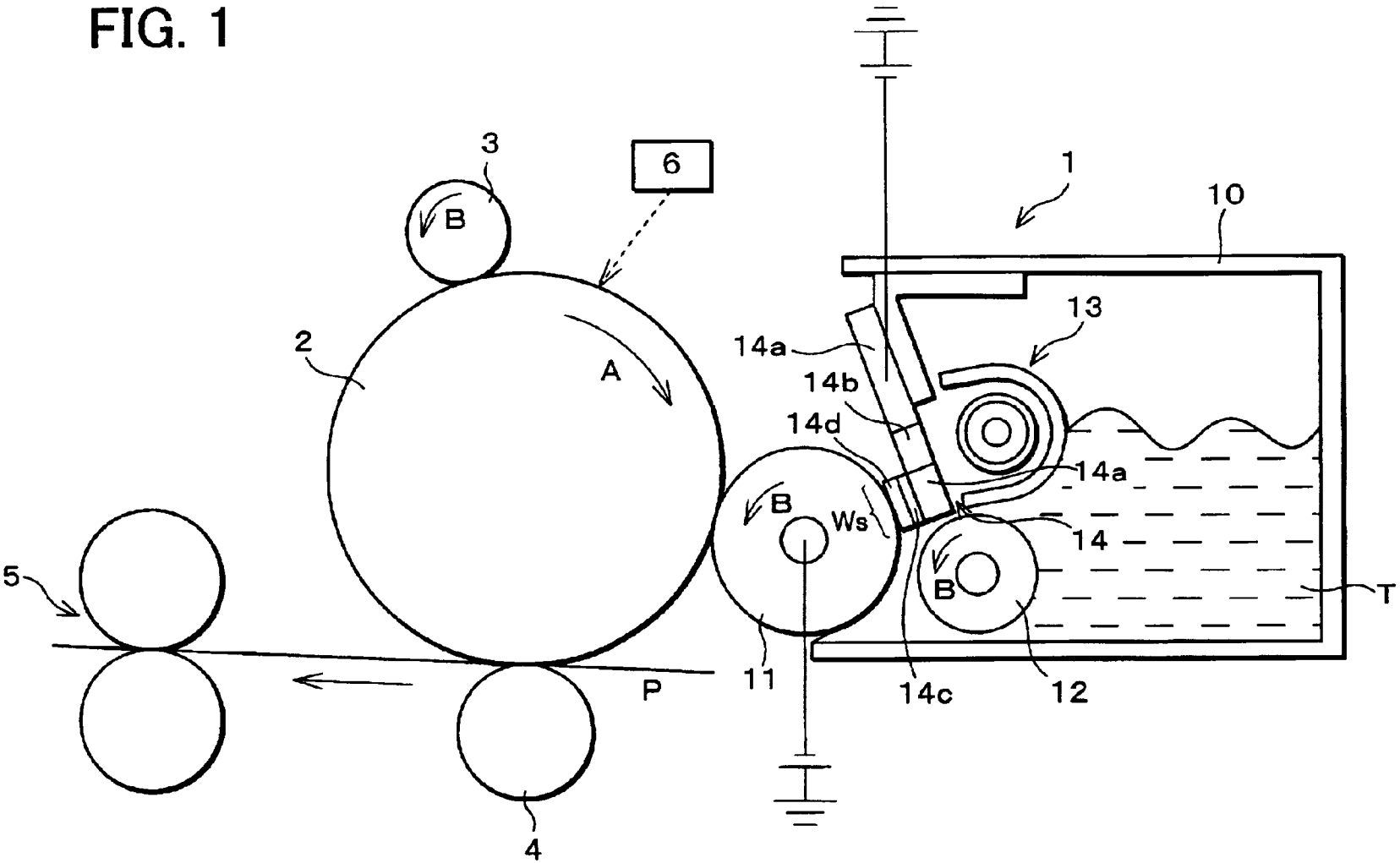
FIG. 1 is a drawing showing an arrangement of the main part of a printer according to an embodiment of the present invention.

FIG. 1 is a drawing showing an arrangement of the main part of a printer (image forming device) according to one embodiment of the present invention. The printer of the present invention includes a development section (development device) 1, a photoconductive drum (latent image holding body) 2, a charging roller 3, a transfer roller (transfer section) 4, a pair of fixing rollers (fixing device) 5, and an LSU (laser beam scanner unit) 6. Further, the printer uses nonmagnetic toner (hereinafter referred to as toner) of one-component system as a developer.

The photoconductive drum 2 has a photoconductor on its surface and given a drum shape. The photoconductive drum 2 is driven by being rotated in a direction denoted by an arrow A at a speed of from 50 to 150 mm/s.

The charging roller 3 evenly charges the surface of the photoconductive drum 2 to a predetermined potential. The charging roller 3 is driven by being rotated toward a direction denoted by an arrow B (opposite direction of that denoted by the arrow A) at the same speed as that of the photoconductive drum 2.

The LSU (Laser beam Scanner Unit) 6 performs exposure with respect to the charged surface of the photoconductive drum 2 by using a laser beam (denoted by a broken line arrow in FIG. 1). Further, the LSU 6 has a function of forming an electrostatic latent image on the surface of the photoconductive drum 2 according to externally supplied image data.

The development section 1 charges the toner T, and then transfers the toner T to the photoconductive drum 2. The toner T thus charged by the development section 1 develops the electrostatic latent image, which has been formed on the photoconductive drum 2 by the LSU 6, so as to create a toner image (developer image) on the photoconductive drum 2. The development section 1 will be minutely described later.

Further, the transfer roller 4 is electrically connected to the surface of the photoconductive drum 2 via a sheet P by being in contact with the sheet P carried by a carriage section. In this arrangement, the toner image on the photoconductive drum 2 is transferred to the sheet (recording medium) P.

The pair of fixing rollers 5 performs thermal fixing of the toner image which has been transferred on the sheet P by thermal compression fixing.

Note that, the sheet P is carried between the transfer roller 4 and the photoconductive drum 2, and between each of the pair of fixing rollers 5, by a carriage belt or a carriage roller (carriage section; not shown).

Here, the following will explain printing operation (image forming operation) in the printer of the present invention.

After being charged by the charging roller 3, the surface of the photoconductive drum 2 is subjected to exposure with a laser beam by the LSU 6. Through this operation, an electrostatic latent image is formed on the surface of the photoconductive drum 2 according to externally supplied image data (image signal).

Then, a development roller 11 (described later) of the development section 1 applies toner to the electrostatic latent image on the photoconductive drum 2, so as to develop (visualize) the electrostatic latent image, which will be a toner image formed on the photoconductive drum 2.

The toner image is transferred to the sheet P between the transfer roller 4 and the photoconductive drum 2, by the transfer roller 4. Then, the sheet P is transferred to the pair of fixing rollers 5, which performs thermal fixing of the toner image to the sheet P. Through this operation, the image data is printed on the sheet P.

Note that, the toner needs to be charged in the development section 1 so as to adhere to the electrostatic latent image on the photoconductive drum 2.

The following will explain a configuration of the development section 1, and a toner charging method which has a particular arrangement to be used in the printer according to the present embodiment.

Figure 4:
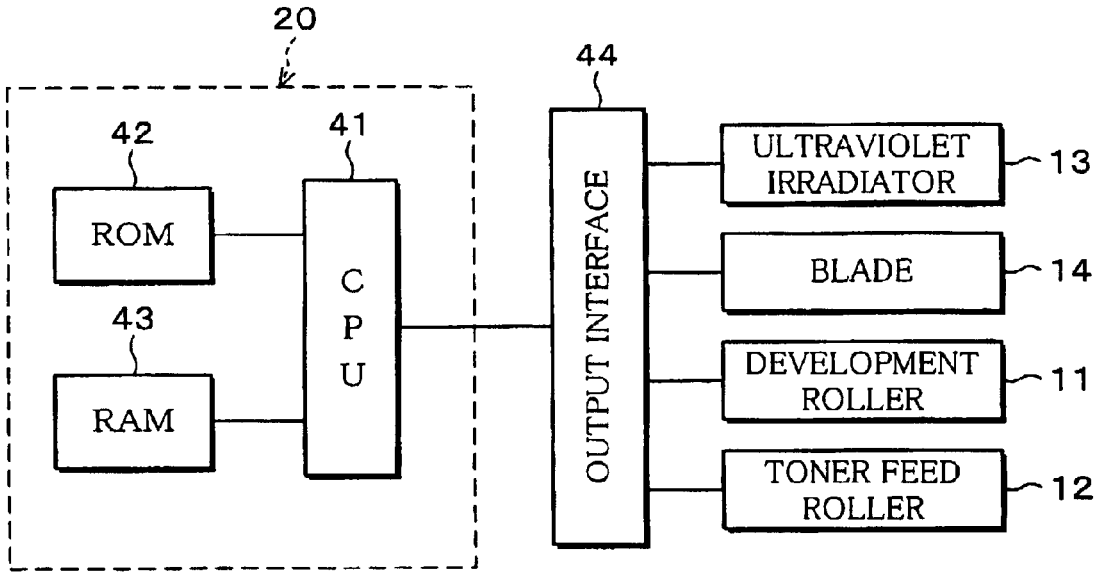
FIG. 4 is a block diagram showing an arrangement of the main part of a development device.
Figure 5:
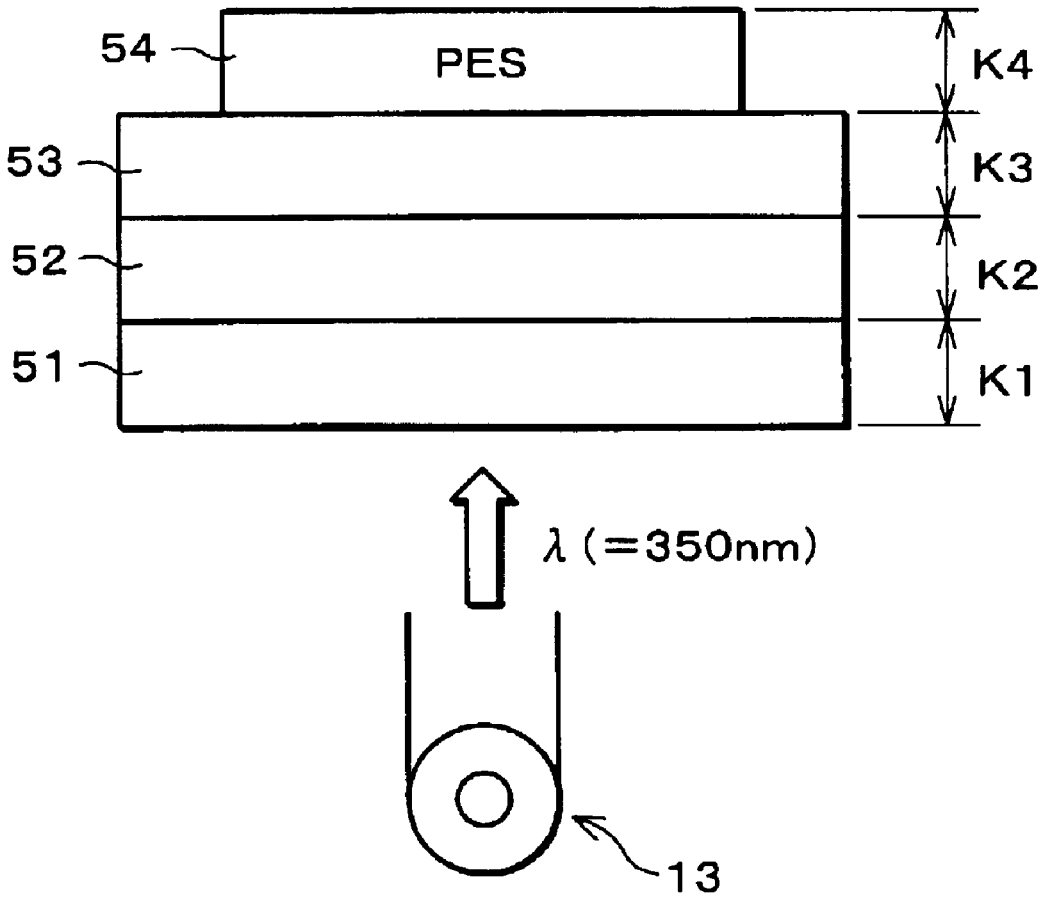
FIG. 5 is a drawing showing an arrangement of a photoelectric charging test.

Firstly, the following will explain the arrangement of the development section 1 with reference to FIGS. 1, 4 and 5.

As shown in FIG. 1, the development section 1 includes a developer tank 10, a development roller (developer carriage section) 11, toner feed roller (feeding section) 12, ultraviolet irradiator (irradiation section) 13 and a toner thickness control/charging blade (hereinafter referred to as a blade) 14.

The developer tank 10 is a tank type container (toner tank) for keeping the toner T.

The development roller 11 is made in a cylinder shape, and made of an Al (aluminum) tube having a rubber layer of conductive rubber elasticity material. Further, the development roller 11 is a rotation roller provided to be opposite to the photoconductive drum 2 and driven by being rotated toward a direction denoted by an arrow B (opposite direction to the photoconductive drum 2) while being in contact with the photoconductive drum 2 at a speed of from 50 to 150 mm/s (the same speed as that of the photoconductive drum 2) with the toner held therein. In this arrangement, the toner T can adhere to the electrostatic latent image on the photoconductive drum 2, so as to develop the electrostatic latent image to a toner image.

The toner feed roller 12 is a rotation roller made of an expandable rubber elasticity material of a cylinder shape. The toner feed roller 12 is provided to be opposite to the development roller 11 in the developer tank 10. The toner feed roller 12 is supplied with a predetermined bias voltage so as to absorb/hold the toner T in the developer tank 10. Further, the toner feed roller 12 is rotated toward the same direction as that of the development roller 11 (the direction B) with the toner T held therein at the same speed as that of the development roller 11, so as to feed the toner T in the developer tank 10 to the periphery surface of the development roller 11. Hereinafter, a layer of the toner on the periphery surface of the development roller 11 is referred to as a toner layer.

The ultraviolet irradiator 13 is an ultraviolet lamp (low pressure mercury lamp), and operates as a light source for irradiating a blade 14 (described later) with ultraviolet (light). The ultra violet irradiator 13 is provided to be opposite to the development roller 11 by having the blade 14 therebetween. The ultraviolet irradiator 13 irradiates the photoelectric surface 14*b* of the blade with ultraviolet so as to charge the toner layer on the development roller 11.

The blade (charging section) 14 is provided upstream of the portion where the photoconductive drum 2 and the development roller 11 come in contact with each other, in the rotation direction of the development roller 11. Further, the blade 14 controls the thickness of the toner layer on the development roller 11 created by the toner feed layer 12 and then charges the toner layer (toner), in the downstream of the portion where the photoconductive drum 2 and the development roller 11 come in contact with each other.

The blade 14 includes a base material 14*a*, a photoelectric surface (electron emission section) 14*b*, an insulation section 14*c*, and a plate (thickness control section) 14*d*. The photoelectric surface 14*b* and the plate 14*d* are provided to be opposite to the development roller 11.

The base material 14*a* is made of a transparent acryl resin base having ultraviolet permeability and coated with ITO (Indium-Tin-Oxide), i.e., having an ITO layer. The base material 14*a* is made in a plate shape.

Note that, the material of the base is not limited but may be any materials having ultraviolet permeability, such as a quartz glass.

Further, the material for coating the base is not limited but may be any materials having ultraviolet permeability and conductivity.

The photoelectric surface 14*b* is a metal layer made of aluminum (Al), for example. The metal layer is formed on the ITO layer of the base material 14*a* through coating or vapor deposition/sputtering. The photoelectric surface 14*b* has a function of discharging electrons (photoelectrons) by evoking the electrons due to photoelectric effect with ultraviolet irradiation supplied from the ultraviolet irradiator 13. Further, the photoelectric surface 14*b* is a thin film whose thickness is not more than 100 nm.

Note that, the material of the metal layer is not particularly limited but may be any materials having photoelectric effect (electron evoking material); for example it may be a semiconductor such as GaAs, or a titanium oxide, which is used for photocatalyst.

The insulation section 14*c* is provided between the ITO layer of the base material 14*a*, which is the main body of the blade 14, and the plate 14*d*, so as to fasten the blade 14*d*. The insulator 14*c* has an insulation property and is made of fluorocarbon resin, for example.

The plate 14*d* is in contact with the development roller 11 in a contact area Ws, and therefore controls the thickness of the toner to a constant thickness (unifies the thickness). Namely, the plate 14*d* operates to control the thickness of the toner layer (layer thickness). The plate 14*d* may be made of a metal such as SUS.

Further, a bias voltage is supplied between the base 14*a* of the blade 14 and the development roller 11 so that the electric field intensity in the micro gap between the plate 14*d* and the development roller 11 becomes $0.5\times10^{-7}$ to $2.5\times10^{-7}$ V/m.

Therefore, due to the application of the bias voltage, the electrons (photoelectrons) induced from the metal layer of the photoelectric surface 14*b* of the blade 14 induce electron multiplication by avalanche between the blade 14 and the development roller 11, and are accelerated toward the development roller 11. Further, the electrons reach to the toner layer on the development layer 11. As a result, the toner on the development roller 11 is charged.

Further, the following will describe the avalanche. That is, the electrons, which are induced from the metal layer of the photoelectric surface 14*b* and accelerated by the bias voltage, hit molecules of gases in the air ($O_2$, $N_2$ etc.) between the blade 14 and the development roller 11, and cause ionization of the gases so that the molecules of the gases are discharged. Further, the newly generated electrons due to the ionization are accelerated by the bias voltage, and cause ionization of other molecules and further discharge. This multiplication of electrons is referred to as avalanche.

As described, in such an avalanche, the electrons generated due to photoelectric effect and accelerated by the bias voltage hit molecules of gases in the air. Thus, by causing ionization of these electrons, it is possible to generate new electrons and causes the new electrons to induce the ionization one after another. Further, the number of electrons thus increased due to the avalanche is used as a target value when determining the level of ultraviolet irradiation or the level of voltage application.

Further, the surface roughness of the development roller 11 is in a range from 0.5 to 2 $\mu$m and the surface roughness of the plate 14*d* of the blade 14 is of not more than 0.3 $\mu$m.

As described, by adjusting the surface roughness of the development roller 11 to be greater than that of the blade 14, it is possible to prevent adherence of the toner to the surface of the blade 14 by being transferred from the development roller 11 when the toner carried by the development roller 11 passes through the contact surface between the development roller 11 and the blade 14 (plate 14*d*).

Here, the following will explain a photoelectric effect. Electrons on the surface (surface electrons) of a metal or a semiconductor are externally induced and discharged by external energy supply of at or greater than a predetermined value (work function). The photoelectric effect is a phenomenon in which the surface electrons are supplied with such energy by irradiation and then emitted as electrons.

With reference to FIG. 5, the following will explain an example of a photoelectric charging test, which induces electron evocation on the photoelectric surface 14*b* of the blade 14 with ultraviolet irradiation.

Here, a plate is created instead of the blade 14 in a similar condition. This plate is created by, firstly, forming an ITO layer 52, and a metal layer 53 made of aluminum GaAs in this order on the surface of a transparent acryl plate 51 having ultraviolet permeability through vacuum deposition; then, on this plate, placing a PES (Polyether Sulfone) 54 made of polyester resin (material of toner) instead of the toner as a target of the charging.

Note that, the thickness K1 of the transparent acryl plate is set to 1 to 5 mm, the thickness K2 of the ITO layer 52 is set to tens of nano meters, the thickness K3 of the metal layer 53 is also set to tens of nano meters, and the thickness K4 of the PES 54 is set to 10 to 100 $\mu$m.

Then, the plate is irradiated with ultraviolet whose wavelength $\lambda$ is 350 nm by the ultraviolet irradiator 13 from a surface opposite to the surface of the PES 54. Here, the irradiation energy is 0.1 to 10 mW/cm$^2$, and the irradiation time is several seconds.

As a result, the surface of the PES 54 is charged to −150 to −30V. This result revealed that the toner can be charged even when there is no speed difference between the toner (a member subjected to charging) and the blade 14 (a member for performing charging).

Further, a control section 20 shown in FIG. 4 controls the respective operations of the foregoing development roller 11, the toner feed roller 12, the ultraviolet irradiator 13, and the blade 14, i.e., the members constituting the development section 1.

As shown in FIG. 4, the control section 20 includes a CPU (Central Processing Unit) 41, a ROM (Read Only Memory) 42, and a RAM (Random Access Memory) 43.

The ROM 42 is a memory for storing various programs (such as operation programs of the development roller 11, the toner feed roller 12, the ultraviolet irradiator 13, and the blade 14 etc.) used by the CPU 41. The RAM 43 is a memory used in operations carried out by the CPU 41.

The CPU 41 is a brain of the printer of the present invention, and caries out programs in the ROM 42 based on such as a signal inputted from a control panel (not shown) by a user, and gives/receives data to/from the RAM 43, so as to control printing operation (image forming operation), pre-printing operation (initialization operation and preliminary operation in the development section 1 (controlled by the control section 20): described later), and after-printing operation (final operation and stopping operation) in the printer.

Further, the CPU 41 outputs various operation signals to the members of the development section 1, such as the development roller 11, the toner feed roller 12, the ultraviolet irradiator 13, or the blade 14, via an output interface 44.

Namely, the control section 20 controls the timings of application of a voltage to the ultraviolet irradiator 13, application of a voltage to the blade 14 (i.e., to the photoelectric surface 14*b*), application of a voltage to the development roller 11, and rotation of the development roller 11 (beginning of carriage of the developer by the development roller 11).

Next, the following will explain a toner charging method in the development section 1. This toner charging method includes operation control for realizing stable charging of the toner even immediately after the beginning of developer carriage by the development roller 11. Note that, this operation control is carried out as a preliminary operation of the development section 1 before the foregoing printing operation. Namely, the preliminary operation of the development section 1 is carried out immediately after printing request (image forming request), which is made to the printer by a user.

In the preliminary operation of the development section 1, firstly, a voltage is applied to the ultraviolet irradiator 13, and the blade 14 is irradiated with ultraviolet (light). As a result, electrons are induced in the photoelectric surface 14*b* of the blade 14.

Then, when an irradiation detection section (not shown) detects that an ultraviolet lamp of the ultraviolet irradiator 13 is lit (i.e., the detection section detects the voltage application to the ultraviolet irradiator 13), a voltage is then applied to the blade 14 (i.e., to the photoelectric surface 14*b* through the base material 14*a*) after a predetermined time is elapsed after the detection. As a result, the electrons are emitted from the photoelectric surface 14*b* of the blade 14.

Next, a voltage is applied to the development roller 11. Then, after a predetermined time is elapsed after a roller voltage detection section (not shown) detects that a voltage is applied to the development roller 11, the control section 20 rotates the development roller 11 so as to start the toner carriage.

As described, the blade 14 is not supplied with a voltage until a predetermined time is elapsed after the voltage application to the ultraviolet irradiator 13. Thus, the blade 14 is supplied with a voltage after the irradiation quantity from the ultraviolet irradiator 13 becomes stabilized through the predetermined time period. On this account, it is possible to sufficiently induce the electrons on the photoelectric surface 14*b*, and unfailingly emit the electrons to the toner on the development roller 11.

The quantity of the electrons emitted from the photoelectric surface 14*b* normally varies depending on the machine life of the development device. Thus, the predetermined time period before the voltage application to the blade 14 is previously decided according to the total printing number (the number of sheets P which have been printed since the development section 1 is mounted to the printer), for example.

Further, by applying a voltage to the development roller 11 after the electron emission from the blade 14 becomes stable due to the voltage application to the blade 14, it is possible to stabilize the surface potential of the development roller 11. As a result, when the toner is carried by the development roller 11 in a later operation, the toner will be stabilized on the surface of the development roller 11, and hence the toner is prevented from being scattered from the surface of the development roller 11. Therefore, it is possible to sufficiently apply the toner to an electrostatic latent image, and prevent a decrease of printing quality such as blank spots on the printed image or unfocused printing.

Note that, the level of the voltage applied to the blade 14 is decided according to the distance between the photoelectric surface 14*b* of the blade 14 and the development roller 11.

Generally, when the voltage applied to the blade 14 is too high, aerial discharge (spark discharge) occurs between the photoelectric surface 14*b* and the development roller 11. This causes removal or breakage of the metal layer formed as photoelectric surface 14*b*, and further brings about a pinhole etc. on the photoelectric surface 14*b*. When the thin film, such as the metal layer provided as the photoelectric surface 14*b*, is lost due to such a removal or breakage, there arises a difficulty of stable charging of the toner.

Therefore, the level of the voltage applied to the blade 14 is decided based on the Paschen's low.

In the Paschen's low, when the electrodes (the blade 14 and the development roller 11 in this case) have the lacunal distance G ($\mu$m) is of 8 to 100 nm therebetween, the aerial discharge starting voltage V1 (V) in the electrodes satisfies the following equation (5).

$$V1=312+6.2\times G \tag{5}$$

According to the equation, when the distance (lacunal distance) between the photoelectric surface 14*b* of the blade 14 and the development roller 11 is 100 (μm), it is necessary to set the potential difference Va (V) between the photoelectric surface 14*b* and the development roller 11 to be smaller than 932V.

Namely, when assuming that the distance between the photoelectric surface 14*b* of the blade 14 and the development roller 11 is 1 (μm), the potential difference Va (V) between the photoelectric surface 14*b* of the blade 14 and the development roller 11 satisfies the following inequality.

$$Va<312+6.2\times1$$

With this arrangement, it is possible to prevent the occurrence of removal or breakage of such as the metal film formed as the photoelectric surface 14*b*, and further prevent the occurrence of a pinhole etc. on the photoelectric surface 14*b*, thus stably charging the toner on the development roller 11.

As described the development section according to the printer of the present invention includes a blade 14 for applying electrons generated in its photoelectric surface 14*b* due to a photoelectric effect to a toner so as to charge the toner; an ultraviolet irradiator 13 for irradiating the photoelectric surface 14*b* with light so as to generate electrons on the photoelectric surface 14*b*; a development roller 11 for holding the toner thus charged, and performing carriage of the toner to a photoconductive drum 2 having an electrostatic latent image on a surface. The development section 1 carries out development of the electrostatic latent image on the photoconductive drum 2 by the charged toner. The development section 1 further includes a control section 20 for performing control of application of a voltage to the ultraviolet irradiator 13, application of a voltage to the photoelectric surface 14*b*, application of a voltage to the development roller 11, and beginning of the carriage of the toner by the development roller 11, at predetermined timings, respectively.

Further, the control section 20 controls application of a voltage to the ultraviolet irradiator 13, application of a voltage to the photoelectric surface 14*b*, application of a voltage to the development roller 11, and beginning of carriage of the toner by the development roller 11, in this order.

Here, the following will explain a comparative example 1 in which the application of a voltage to the ultraviolet irradiator 13, the application of a voltage to the blade 14 (i.e., to the photoelectric surface 14*b*), the application of a voltage to the development roller 11, and the beginning of rotation of the development roller 11 are carried out at the same time immediately after the printing request; in other words, all members of the development section 1 are turned on immediately after the printing request.

Generally, in a charging method using light energy, when all members of the development section 1 (at least including the ultraviolet irradiator 13, the photoelectric surface 14*b*, and the development roller 11) are turned on at the same time, the toner cannot be sufficiently charged immediately after the irradiation, i.e., immediately after the beginning of toner carriage.

Namely, in this comparative example 1, the toner carriage is started immediately after the printing request even though the electrons on the photoelectric surface 14*b* have not been sufficiently induced.

As described, in the presence of uncharged toner, such as the time immediately after the printing request, the potential of the toner varies, and therefore the toner may be charged apparently in a reverse polarity due to contact and friction between the toner in the process of the carriage. More specifically, proper charging may be interfered by the peripheral toner. The toner charged in a reverse polarity gravitates toward an electric field of electrical bias, and adheres to the photoelectric surface 14*b* where the electrons are emitted. When the toner adheres to the photoelectric surface 14*b* due to such a phenomenon, the adhering toner interferes the emission of the electrons on the photoelectric surface 14*b*, thus decreasing toner charging ability in the photoelectric surface 14*b*. As a result, charging of the carried toner becomes unstable.

Besides, if this toner stain on the photoelectric surface 14*b* is cleaned away with a mechanical method, for example, by using a brush or a blade, the metal layer formed as the photoelectric surface 14*b* tends to peel off or wear out. This peel-off or wear-out disables the electron emission on the photoelectric surface 14*b* even with irradiation, thereby failing to stably charge the toner.

If the toner, which is still in an uncharged state, is carried to the photoconductive drum 2 by the development roller 11, there arises adherence of the uncharged toner to the electrostatic latent image or scatter of the toner in the printer. As a result, blank spots appear on the image, or the image becomes unfocused, thereby decreasing printing quality.

However, in the printer of the present embodiment, the control section 20 controls the application of a voltage to the ultraviolet irradiator 13, the application of a voltage to the photoelectric surface 14*b*, the application of a voltage to the development roller 11, and the beginning of carriage of the toner by the development roller 11, at predetermined timings, thus stably charging the toner to be a desirable quantity even immediately after the beginning of the toner carriage.

More specifically, the development roller 11 is rotated for starting toner supply after the occurrence of avalanche of the electrons induced from the photoelectric surface 14*b*, so as to stabilize charging polarity/potential of the toner. In this manner, unlike the foregoing example, it is possible to prevent the toner from being charged apparently in a reverse polarity in the process of the carriage.

As a result, it is possible to prevent the decrease of charging ability in the photoelectric surface 14*b*, thus stabilizing the charging of the carried toner.

Further, for example, the toner will not scatter inside of the printer, thus preventing the decrease of printing quality due to the blank spots on the image or the unfocused printing.

Since the toner is charged by using photoelectric effect, the thermal load with respect to the toner can be reduced. Therefore, it is possible to prevent destruction of the toner, or fusion of the toner into the blade. Further, the printer can accept the use of improved toner which is made for realizing reduction of fixing energy or improvement of coloring ability.

Further, since the blade 14 is made in a plate shape and provided with the photoelectric surface 14*b* by forming a metal layer, the photoelectric surface 14*b* can induce and emit the electrons thereof throughout the surface opposite to the development roller 11.

Here, the following will explain an arrangement as a comparative example 2 in which the photoelectric surface 14*b* of the blade 14 is formed as an opening section by carrying out etching on the base material 14*a*.

This opening section in the comparative example 2 can be formed in a shape of a grid, a slit, or the like. The opening section has lamination of thin films of aluminum which emit electrons with ultraviolet irradiation, as the photoelectric surface 14*b*. This arrangement allows the blade 14 to control the thickness of the toner carried by the development roller 11 with low pressure and also charge the toner under unloaded condition, thus reducing the thermal load with respect to the toner.

However, in the comparative example 2 having such an arrangement, the area of the photoelectric surface 14*b* is reduced. For example, in case of not performing the foregoing preliminary operation of the development section 1 in the arrangement of the comparative example 2, adherence of the toner interferes the emission of electrons on the photoelectric surface 14*b*. As a result, the area of the emission of electrons is further reduced, thereby decreasing efficiency of the electron emission.

On the other hand, as described, in the blade 14 of the printer according to the present embodiment, the photoelectric surface 14*b* can induce and emit the electrons thereof throughout the surface opposite to the development roller 11. Further, the development section 1 performs foregoing preliminary operation.

As a result, it is possible to increase efficiency of the electron emission on the photoelectric surface 14*b*, thereby stabilizing charging property of the toner and improving printing quality.

Figure 2:
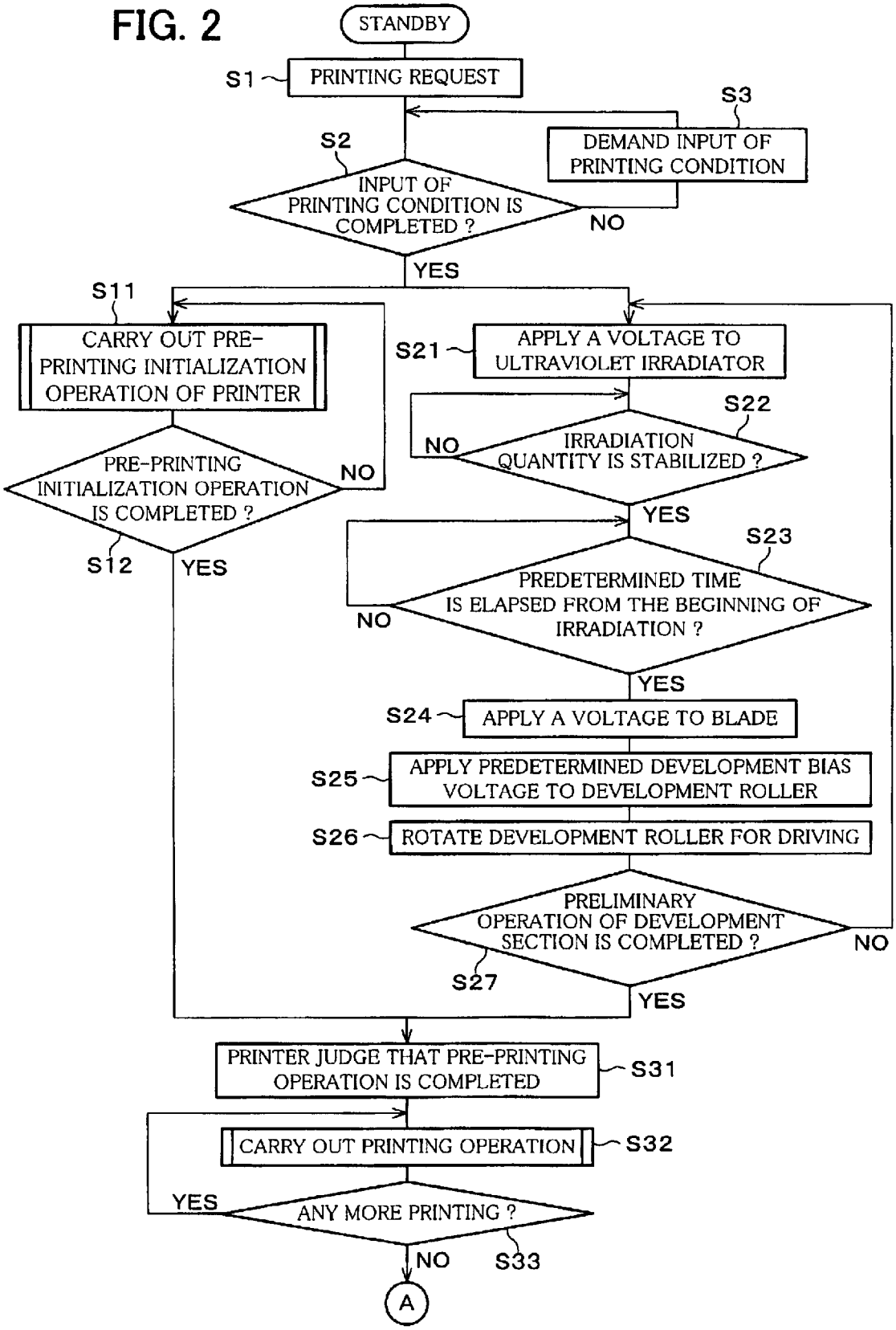
FIG. 2 is a flow chart showing pre-printing operation and printing operation.
Figure 3:
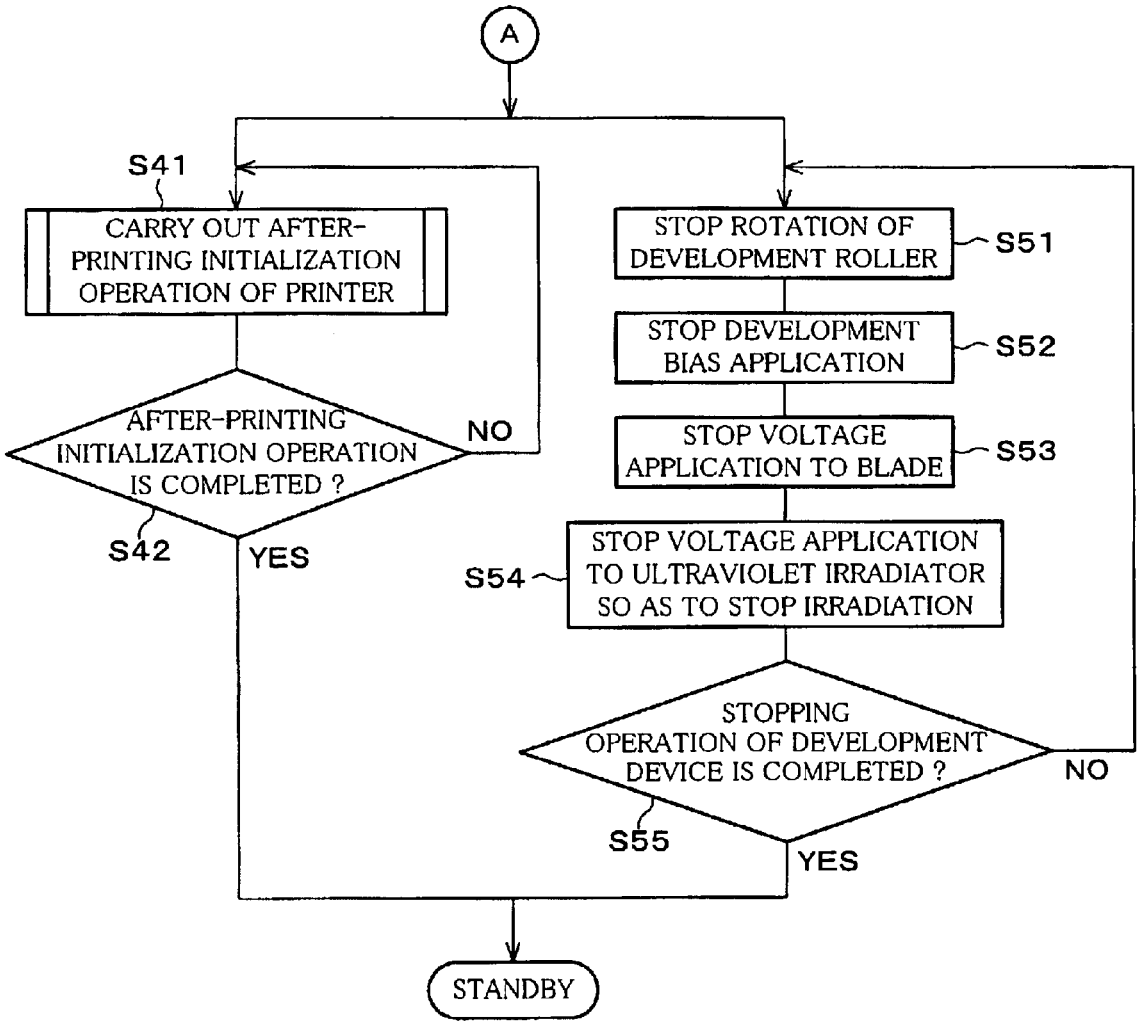
FIG. 3 is a flow chart showing after-printing operation.

With reference to the flow chart shown in FIGS. 2 and 3, the following will explain an example of each operation in the printer from a process of making the printing request to the printer which has been in a standby state to a process of setting the printer back in the standby state again after the printing operation.

Firstly, as shown in FIG. 2, printing request is made (S1) to the printer by a user via a display section (not shown), and also printing conditions are inputted via a display panel (not shown) or a terminal device on a network to which the printer is connected (S2, S3).

Then, when the input of the printing conditions is completed (Yes in S2), before start printing, the preliminary operation (timing control by the control section 20: S21 through S27) of the development section 1 is carried out together with pre-printing initialization operation in the printer (initialization operation: S11 through S12).

The pre-printing initialization operation in the printer (S11) is required to be performed before the printing operation, and includes, for example, initialization of the photoconductive drum 2 (adjustment of residual potential), warm-up of the pair of fixing rollers 5 (temperature adjustment), initialization operation of the respective sensors inside of the printer, detection of the presence or absence of the sheet P remaining on the carriage section, and further may include such as initialization of the members of the printer.

As described, the preliminary operation of the development section 1 is carried out in such a manner that a voltage is firstly applied to the ultraviolet irradiator 13 (S21); then, after detection of the voltage application to the ultraviolet irradiator 13 (S22) and when a predetermined time is elapsed (S23), a voltage is applied to the photoelectric surface 14*b* of the blade 14 (S24).

Thereafter, the development roller 11 is supplied with a voltage (S25) before the development roller 11 starts its rotation (S26).

In such a manner, when the preliminary operation of the development section 1 is finished and also pre-printing initialization operation in the printer is finished (S12, S27), the printer judges that the pre-printing operation (operation required before the printing operation, pre-printing action) is completed (S31), and now carries out the printing operation (S32).

Further, when the printing operation is completed (No in S33), the printer carries out stopping operation of the development section 1 (S51 through S55) together with after-printing initialization operation (final operation: S41 through S42), as shown in FIG. 3.

The after-printing initialization operation of the printer (S41) is required to be performed after the printing operation so as to set the printer back in the standby state. The after-printing initialization operation includes, for example, removal of residual potential in the photoconductive drum 2, detection of the presence or absence of the sheet P remaining on the carriage section, removal (cleaning) of residual toner on the photoconductive drum 2 and the like.

Further, the stopping operation of the development section 1 is carried out by performing the steps of the preliminary operation of the development section 1 in the reverse order. Namely, firstly, the rotation of the development roller 11 is stopped (S51), and then the voltage application to the development roller 11 is stopped (S52).

Further, the voltage application to the blade 14 is stopped (S53), and then the voltage application to the ultraviolet irradiator 13 is stopped so as to stop the ultraviolet irradiation (S54).

In this manner, when the printer finishes both the stopping operation of the development section 1 and the after-printing initialization operation (S42, S55), the printer goes back in the standby state, as the after printing operation is all completed.

In the foregoing manner, the printer carries out the stopping operation of the development section 1 (S51 through S55) together with the after-printing initialization operation (final operation: S41 through S42).

As described, by carrying out the stopping operation of the development section 1 with the final operation in the printer, it is not necessary to spend the time only for the stopping operation of the development section 1. Further, it is also possible to collect the charged toner, prevent stains on the photoelectric surface 14*b*, and prolong the life of the ultraviolet irradiator 13.

Further, the development section 1 carries out the stopping operation by performing the steps of the preliminary operation in the reverse order. Namely, the development section 1 stops the carriage of the toner by the development roller 11, the application of a voltage to the development roller 11, the application of a voltage to the photoelectric surface 14*b*, and the application of a voltage to the ultraviolet irradiator 13, in this order as the stopping operation.

As described, by stopping the voltage application to the development roller 11 after stopping the toner carriage by the development roller 11, it is possible to make the toner, which has been used in the printing operation (image forming operation), to keep adhering to the development roller 11.

Further, by stopping avalanche at the end, it is possible to keep the uncharged toner in the vicinity of the photoelectric surface 14*b* to adhere to the development roller 11.

Therefore, the toner will not scatter inside of the printer when the printer is set in the standby state, thus using the charged toner again at the next time (by collecting the toner). On this account, the toner will not adhere to the photoelectric surface 14*b*, and the photoelectric surface 14*b* is prevented from being stained. As a result, it is possible to decrease the input voltage to the light source in the ultraviolet irradiator 13, and prolong the life of the ultraviolet irradiator 13. Further, the toner supply can be smoothly carried out at the next printing request.

With this arrangement, it is possible to keep the toner used in the printing operation (image forming operation) and the uncharged toner in the vicinity of the photoelectric surface 14*b* to adhere to the development roller 11. Therefore, the toner will not scatter inside of the printer when the printer is set in the standby state. Further, the toner supply can be smoothly carried out at the next printing request.

Note that, though the present embodiment uses nonmagnetic toner of one-component system as the developer, the present invention is not limited to this type of developer.

Further, the present invention is not particularly limited to a printer but can be any devices capable of carrying out the foregoing operation control as a charging method of the developer. For example, an electrophotography type image forming device, such as a photocopier, a printer, or a facsimile device, may also be included.

As described, the development device according to the present invention is preferably arranged so that the control section performs the control so that the (b) application of a voltage to the electron emission section is carried out when irradiation quantity from the irradiation section becomes substantially constant after the (a) application of a voltage to the irradiation section.

With the foregoing arrangement, the electron emission section is not supplied with a voltage until the predetermined time period is elapsed after the application of a voltage to the irradiation section. Thus, the application of a voltage to the electron emission section is carried out when irradiation quantity from the irradiation section becomes stabilized through the predetermined time period. As a result, it is possible to sufficiently induce the electrons on the electron emission section, and unfailingly emit the electrons to the developer on the developer carriage section.

Further, the development device according to the present invention is preferably arranged so that the control section performs the control so that the (c) application of a voltage to the developer carriage section is carried out when a predetermined time period is elapsed after the (b) application of a voltage to the electron emission section.

With the foregoing arrangement, since a voltage is applied to the developer carriage section after the electron emission from the electron emission section becomes stable, it is possible to stabilize the surface potential of the development carriage section. As a result, the developer on the developer carriage section is unified in the thickness and charging quantity.

Further, the development device according to the present invention is preferably arranged so that the control section performs the control so that the (d) beginning of the carriage of the developer by the developer carriage section is carried out after the (c) application of a voltage to the developer carriage section.

With the foregoing arrangement, since the carriage of the developer is carried out after the surface potential of the development carriage section becomes stable, the developer is stably carried on the developer carriage section. Therefore, the developer is prevented from being scattered from the surface of the developer carriage section. As a result, the developer is sufficiently applied to the electrostatic latent image.

Further, the development device according to the present invention is preferably arranged so that the electron emission section is made of a semiconductor or a metal.

The foregoing arrangement allows the charging section having the electron emission section to easily emit the electrons (provided with a photoelectric effect). This enables direct application of the electrons induced by the irradiation with respect to the developer, and hence the developer can be easily charged. On this account, it is possible to charge the developer even when there is a gap between the charging section and the developer carriage section, thus reducing thermal load with respect to the developer.

Further, the development device according to the present invention is preferably arranged so that a bias voltage is applied between the electron emission section and the developer carriage section.

With the foregoing arrangement, the electrons induced from the electron emission section induce electron multiplication by avalanche between the electron emission section and the developer carriage section, and are accelerated toward the developer carriage section. Here, the accelerated electrons hit molecules of gases in the air, and generate new electrons one after another, by causing ionization of the gases.

Further, the development device according to the present invention is preferably arranged so that the charging section includes a thickness control section for controlling a thickness of the developer on the developer carriage section to be a constant thickness.

With the foregoing arrangement, it is possible to control the thickness of the developer without a thermal load.

Further, the development device according to the present invention is preferably arranged so that the thickness control section is provided on an upstream portion of the electron emission section in a developer carriage direction of the developer carriage section.

With the foregoing arrangement, the developer is charged after being controlled in the thickness. As a result, the developer is free from force after being charged and therefore can be stably carried.

Further, the development device according to the present invention is preferably arranged so that the developer carriage section opposite to the thickness control section has a greater surface roughness than that of the thickness control section opposite to the developer carriage section.

With the foregoing arrangement, it is possible to prevent adherence of the developer to the charging section by being transferred from the developer carriage section when, for example, the developer carried by the developer carriage section passes through the contact surface between the developer carriage section and the thickness control section.

Further, the development device according to the present invention is preferably arranged so that voltage difference Va (V) between the electron emission section and the developer carriage section satisfies $Va<312+6.2\times1$ where a distance between the electron emission section and the developer carriage section is 1 ($\mu$m).

With the foregoing arrangement, it is possible to prevent the occurrence of removal or breakage of such as a metal layer formed as the electron emission section, thus stably charging the developer on the developer carriage section.

Further, the development device according to the present invention is preferably arranged so that the (a) application of a voltage to the irradiation section, the (b) application of a voltage to the electron emission section, the (c) application of a voltage to the developer carriage section, and the (d) beginning of the carriage of the developer by the developer carriage section, are carried out in this order.

With the foregoing method, the electron emission is not supplied with a voltage until a predetermined time is elapsed after the voltage application to the irradiation section. Thus, the electron emission section is supplied with a voltage after the irradiation quantity from the irradiation section becomes stabilized through the predetermined time period. On this account, it is possible to sufficiently induce the electrons on the electron emission section, and unfailingly emit the electrons to the developer on the developer carriage section.

Further, since a voltage is applied to the developer carriage section after the electron emission from the electron emission section becomes stable, it is possible to stabilize the surface potential of the development carriage section. As a result, the developer on the developer carriage section is unified in the thickness and charging quantity.

Further, since the carriage of the developer is carried out after the surface potential of the development carriage section becomes stable, the developer is stably carried on the developer carriage section. Therefore, the developer is prevented from being scattered from the surface of the developer carriage section. As a result, the developer is sufficiently applied to the electrostatic latent image, thus preventing blank spots or unfocused printing of an image at the image forming by the image forming device.

Further, the charging method according to the present invention is preferably arranged so that the (a) application of a voltage to the irradiation section, the (b) application of a voltage to the electron emission section, the (c) application of a voltage to the developer carriage section, and the (d) beginning of the carriage of the developer by the developer carriage section, are carried out before the image forming.

With the foregoing method, since the application of a voltage to the irradiation section, the application of a voltage to the electron emission section, the application of a voltage to the developer carriage section, and the beginning of the carriage of the developer by the developer carriage section, are carried out together with the initialization operation of the image forming device, which is regularly carried out in the image forming device before the image forming operation, thus preventing the developer from being excessively charged.

Further the image forming device according to the present invention, includes: a latent image holding body for holding a electrostatic latent image which is formed based on an image signal; and a development device including (i) a charging section for applying electrons generated in an electron emission section due to a photoelectric effect to a developer, so as to charge the developer, (ii) an irradiation section for irradiating the electron emission section with light, (iii) a developer carriage section for holding the developer which has been charged, and performing carriage of the developer to the latent image holding body, and (iv) a control section for performing control of (a) application of a voltage to the irradiation section, (b) application of a voltage to the electron emission section, (c) application of a voltage to the developer carriage section, and (d) beginning of the carriage of the developer by the developer carriage section, at predetermined timings, respectively, the development device developing the electrostatic latent image on the latent image holding body to a developer image with the developer which has been charged.

With the foregoing arrangement, since the control section control the application of a voltage to the irradiation section, the application of a voltage to the electron emission section, the application of a voltage to the developer carriage section, and the beginning of the carriage of the developer by the developer carriage section, at predetermined timings, the developer can be stably charged to be a desirable quantity even immediately after the beginning of the developer carriage.

Thus, it is possible to prevent the developer from being carried in an uncharged state, and therefore prevent the decrease of charging ability in the electron emission section, thus stabilizing the charging of the carried developer.

Further, the developer will not scatter inside of the printer, thus preventing the decrease of printing quality due to the blank spots on the image or the unfocused printing.

Since the developer is charged by using photoelectric effect, the thermal load with respect to the developer can be reduced. Therefore, it is possible to prevent destruction of the developer, or fusion of the developer into the charging section. Further, the development device can accept the use of improved developer which is made for realizing reduction of fixing energy or improvement of coloring ability.

Further, the image forming device according to the present invention is preferably arranged so that the control section carries out the (a) application of a voltage to the irradiation section, the (b) application of a voltage to the electron emission section, the (c) application of a voltage to the developer carriage section, and the (d) beginning of the carriage of the developer by the developer carriage section, in this order.

With the foregoing arrangement, the electron emission is not supplied with a voltage until a predetermined time is elapsed after the voltage application to the irradiation section. Thus, the electron emission section is supplied with a voltage after the irradiation quantity from the irradiation section becomes stabilized through the predetermined time period. On this account, it is possible to sufficiently induce the electrons on the electron emission section, and unfailingly emit the electrons to the developer on the developer carriage section.

Further, since a voltage is applied to the developer carriage section after the electron emission from the electron emission section becomes stable, it is possible to stabilize the surface potential of the development carriage section. As a result, the developer on the developer carriage section is unified in the thickness and charging quantity.

Further, since the carriage of the developer is carried out after the surface potential of the development carriage section becomes stable, the developer is stably carried on the developer carriage section. Therefore, the developer is prevented from being scattered from the surface of the developer carriage section. As a result, the developer is sufficiently applied to the electrostatic latent image, thus preventing blank spots or unfocused printing of an image at the image forming by the image forming device.

Further, the image forming device according to the present invention is preferably arranged so that after an image forming request is made by a user, the control section carries out initialization operation of the image forming device together with the control, before starting image forming by forming the electrostatic latent image on the latent image holding body.

With the foregoing arrangement, since the application of a voltage to the irradiation section, the application of a voltage to the electron emission section, the application of a voltage to the developer carriage section, and the beginning of the carriage of the developer by the developer carriage section, can be carried out together with the initialization operation of the image forming device, which is regularly carried out in the image forming device before the image forming operation, it is not necessary to spend time only for the control operation of the control section.

Further, it is possible to prevent the developer from being excessively charged, and also realize stress reduction of the developer inside of the development device. Further, the life of the electron emission section and the life of the irradiation section can be prolonged.

Further, the image forming device according to the present invention is preferably arranged so that; the device further includes a transfer section electrically connected to a surface of the latent image holding body via a recording medium by being in contact with the recording medium, and transfers the developer image to the recording medium; a fixing device for fixing the developer to the recording medium through thermal fixing; and a carriage section for carrying the recording medium, the initialization operation including warm-up of the fixing device, adjustment of a residual voltage of the latent image holding body, and detection of presence or absence of the recording medium on the carriage section.

With the foregoing arrangement, the image forming operation can be started immediately after the initialization operation and the operation control of the control section.

Further, the image forming device according to the present invention is preferably arranged so that the control section applies a voltage to the irradiation section, and after a predetermined time is elapsed, applies a voltage to the electron emission section, the predetermined time being previously decided according to a cumulative number of image forming on the recording medium in the image forming device.

The quantity of the electrons emitted from the electron emission section normally varies depending on the machine life of the development device.

Thus, since the predetermined time period before the voltage application to the electron emission section is previously decided according to the total printing number of recording medium which have been processed for image forming in the image forming device, the voltage application to the electron emission section can be carried out after the irradiation quantity from the irradiation section becomes stable. As a result, it is possible to sufficiently induce the electrons on the electron emission section, and unfailingly emit the electrons to the developer on the developer carriage section.

Further, the development device according to the present invention is preferably arranged so that the control section starts the application of a voltage to the irradiation section immediately after an image forming request is made by a user.

With the foregoing arrangement, a voltage can be firstly applied to the irradiation section. This allows the electron emission section to emit electrons after the irradiation quantity from the irradiation section becomes stable, thus unfailingly charging the developer.

Further, the development device according to the present invention is preferably arranged so that; the device further includes a transfer section electrically connected to a surface of the latent image holding body via a recording medium by being in contact with the recording medium, and transfers the developer image to the recording medium; a fixing device for fixing the developer to the recording medium through thermal fixing; and a carriage section for carrying the recording medium, after image forming of the recording medium is finished by transferring the recording medium to the fixing device, the control section stopping the (a) application of a voltage to the irradiation section, the (b) application of a voltage to the electron emission section, the (c) application of a voltage to the developer carriage section, and the (d) beginning of the carriage of the developer by the developer carriage section, at predetermined timings, respectively, so as to carry out stopping operation of the development device, the stopping operation being carried out together with final operation in the image forming device, which is required to be carried out before setting the image forming device to be back in a standby state.

With the foregoing arrangement, since the stopping operation of the development device is carried out together with the final operation of the image forming device, it is not necessary to spend the time only for the stopping operation of the development device. Further, by carrying out the stopping operation at predetermined timings, it is possible to collect the charged developer, prevent stains on the electron emission section, and prolong the life of the irradiation section.

Further, the image forming device according to the present invention is preferably arranged so that the control section stops the (d) beginning of the carriage of the developer by the developer carriage section, the (c) application of a voltage to the developer carriage section, the (b) application of a voltage to the electron emission section, and the (a) application of a voltage to the irradiation section, in this order so as to carry out the stopping operation.

With the foregoing arrangement, by stopping the voltage application to the developer carriage section after stopping the developer carriage by the developer carriage section, it is possible to make the developer, which has been used in the image forming operation, to keep adhering to the developer carriage section.

Further, by stopping avalanche at the end, it is possible to keep the uncharged developer in the vicinity of the electron emission section to adhere to the developer carriage section.

Therefore, the developer will not scatter inside of the image forming device when the image forming device is set in the standby state, thus using the charged developer again at the next time (by collecting the toner). On this account, the developer will not adhere to the electron emission section, and the electron emission section is prevented from being stained. As a result, it is possible to decrease the input voltage to the light source in the irradiation section, and prolong the life of the irradiation section. Further, the developer supply can be smoothly carried out at the next image forming request.

Further, the image forming device according to the present invention is preferably arranged so that the final operation includes removal of a residual voltage of the latent image holding body, detection of presence or absence of the recording medium on the carriage section, and removal of the developer remaining on the latent image holding body.

With the foregoing arrangement, the stopping operation of the development device can be carried out together with the final operation of the image forming device, which is regularly carried out in the image forming device after the image forming operation.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A development device, comprising:

a charging section having an electron emission section and applying electrons generated in the electron emission section due to a photoelectric effect to a developer so as to charge the developer;

an irradiation section for irradiating the electron emission section with light so as to cause the electron emission section to generate the electrons;

a developer carriage section for holding the developer thus charged, and performing carriage of the developer to a latent image holding body having an electrostatic latent image on a surface; and a control section for performing control of (a) application of a voltage to the irradiation section, (b) application of a voltage to the electron emission section, (c) application of a voltage to the developer carriage section, and (d) beginning of the carriage of the developer by the developer carriage section, at predetermined timings, respectively, the electrostatic latent image on the latent image holding body being developed by the developer which has been charged.

2. The development device as set forth in claim 1, wherein:

the control section performs the control so that the (b) application of a voltage to the electron emission section is carried out when irradiation quantity from the irradiation section becomes substantially constant after the (a) application of a voltage to the irradiation section.

3. The development device as set forth in claim 1, wherein:

the control section performs the control so that the (c) application of a voltage to the developer carriage section is carried out when a predetermined time period is elapsed after the (b) application of a voltage to the electron emission section.

4. The development device as set forth in claim 3, wherein:

the predetermined time period is a time period until electron emission from the electron emission section becomes stabilized after the (b) application of a voltage to the electron emission section.

5. The development device as set forth in claim 1, wherein:

the control section performs the control so that the (d) beginning of the carriage of the developer by the developer carriage section is carried out after the (c) application of a voltage to the developer carriage section.

6. The development device as set forth in claim 1, wherein:

the electron emission section is made of a semiconductor or a metal.

7. The development device as set forth in claim 6, wherein:

the electron emission section is provided by forming the semiconductor or the metal on a base material of the charging section.

8. The development device as set forth in claim 7, wherein:

the base material of the charging section is made of a base which has ultraviolet permeability and coated with a material having ultraviolet permeability and conductivity.

9. The development device as set forth in claim 1, wherein:

the electron emission section has a plate-shaped surface, which is provided to be opposite to the developer carriage section.

10. The development device as set forth in claim 1, wherein:

a bias voltage is applied between the electron emission section and the developer carriage section.

11. The development device as set forth in claim 1, wherein:

the charging section includes a thickness control section for controlling a thickness of the developer on the developer carriage section to be a constant thickness.

12. The development device as set forth in claim 11, wherein:

the thickness control section is provided on an upstream portion of the electron emission section in a developer carriage direction of the developer carriage section.

13. The development device as set forth in claim 11, wherein:

the developer carriage section opposite to the thickness control section has a greater surface roughness than that of the thickness control section opposite to the developer carriage section.

14. The development device as set forth in claim 1, wherein:

voltage difference Va (V) between the electron emission section and the developer carriage section satisfies $Va<312+6.2\times1$ where a distance between the electron emission section and the developer carriage section is 1 ($\mu$m).

15. A charging method for charging a developer so as to develop an electrostatic latent image into a developer image, comprising the step of:

carrying out image forming by supplying the developer, which has been charged, to a latent image holding body having the electrostatic latent image on a surface, and transferring the developer image from the latent image holding body to a recording medium, wherein:

(a) application of a voltage to an irradiation section which performs light irradiation, (b) application of a voltage to an electron emission section which induces electrons thereof by a photoelectric effect with the light irradiation, so as to discharge the electrons, (c) application of a voltage to a developer carriage section which performs carriage of the developer to the latent image holding body having the electrostatic latent image on the surface, and (d) beginning of the carriage of the developer by the developer carriage section, are carried out at predetermined timings, respectively.

16. The charging method as set forth in claim 15, wherein:

the (a) application of a voltage to the irradiation section, the (b) application of a voltage to the electron emission section, the (c) application of a voltage to the developer carriage section, and the (d) beginning of the carriage of the developer by the developer carriage section, are carried out in this order.

17. The charging method as set forth in claim 16, wherein:

the (b) application of a voltage to the electron emission section is carried out when irradiation quantity from the irradiation section becomes substantially constant after the (a) application of a voltage to the irradiation section.

18. The charging method as set forth in claim 16, wherein:

the (c) application of a voltage to the developer carriage section is carried out when a predetermined time period is elapsed after the (b) application of a voltage to the electron emission section.

19. The charging method as set forth in claim 18, wherein:

the predetermined time period is a time period until electron emission from the electron emission section becomes stabilized after the (b) application of a voltage to the electron emission section.

20. The charging method as set forth in claim 16, wherein:

the (d) beginning of the carriage of the developer by the developer carriage section is carried out after the (c) application of a voltage to the developer carriage section.

21. The charging method as set forth in claim 15, wherein:

a bias voltage is applied between the electron emission section and the developer carriage section.

22. The charging method as set forth in claim 15, wherein:

a thickness of the developer on the developer carriage section is controlled to be a constant thickness.

23. The charging method as set forth in claim 15, wherein:

the (a) application of a voltage to the irradiation section, the (b) application of a voltage to the electron emission section, the (c) application of a voltage to the developer carriage section, and the (d) beginning of the carriage of the developer by the developer carriage section, are carried out before the image forming.

24. An image forming device, comprising:

a latent image holding body for holding a electrostatic latent image which is formed based on an image signal; and a development device including (i) a charging section for applying electrons generated in an electron emission section due to a photoelectric effect to a developer, so as to charge the developer, (ii) an irradiation section for irradiating the electron emission section with light, (iii) a developer carriage section for holding the developer which has been charged, and performing carriage of the developer to the latent image holding body, and (iv) a control section for performing control of (a) application of a voltage to the irradiation section, (b) application of a voltage to the electron emission section, (c) application of a voltage to the developer carriage section, and (d) beginning of the carriage of the developer by the developer carriage section, at predetermined timings, respectively, the development device developing the electrostatic latent image on the latent image holding body to a developer image with the developer which has been charged.

25. The image forming device as set forth in claim 24, wherein:

the control section carries out the (a) application of a voltage to the irradiation section, the (b) application of a voltage to the electron emission section, the (c) application of a voltage to the developer carriage section, and the (d) beginning of the carriage of the developer by the developer carriage section, in this order.

26. The image forming device as set forth in claim 25, wherein:

the control section carries out the (b) application of a voltage to the electron emission section when irradiation quantity from the irradiation section becomes substantially constant after the (a) application of a voltage to the irradiation section.

27. The image forming device as set forth in claim 25, wherein:

the control section carries out the (c) application of a voltage to the developer carriage section when a predetermined time period is elapsed after the (b) application of a voltage to the electron emission section.

28. The image forming device as set forth in claim 25, wherein:

the predetermined time period is a time period until electron emission from the electron emission section becomes stabilized after the (b) application of a voltage to the electron emission section.

29. The development device as set forth in claim 25, wherein:

the control section carries out the (d) beginning of the carriage of the developer by the developer carriage section after the (c) application of a voltage to the developer carriage section.

30. The image forming device as set forth in claim 25, wherein:

the control section starts the application of a voltage to the irradiation section immediately after an image forming request is made by a user.

31. The image forming device as set forth in claim 24, wherein:

after an image forming request is made by a user, the control section carries out initialization operation of the image forming device together with the control, before starting image forming by forming the electrostatic latent image on the latent image holding body.

32. The image forming device as set forth in claim 31, further comprising:

a transfer section electrically connected to a surface of the latent image holding body via a recording medium by being in contact with the recording medium, and transfers the developer image to the recording medium;

a fixing device for fixing the developer to the recording medium through thermal fixing; and a carriage section for carrying the recording medium, the initialization operation including warm-up of the fixing device, adjustment of a residual voltage of the latent image holding body, and detection of presence or absence of the recording medium on the carriage section.

33. The image forming device as set forth in claim 24, wherein:

the control section applies a voltage to the irradiation section, and after a predetermined time is elapsed, applies a voltage to the electron emission section, the predetermined time being previously decided according to a cumulative number of image forming on the recording medium in the image forming device.

34. The image forming device as set forth in claim 24, further comprising:

a transfer section electrically connected to a surface of the latent image holding body via a recording medium by being in contact with the recording medium, and transfers the developer image to the recording medium;

a fixing device for fixing the developer to the recording medium through thermal fixing; and a carriage section for carrying the recording medium, after image forming of the recording medium is finished by transferring the recording medium to the fixing device, the control section stopping the (a) application of a voltage to the irradiation section, the (b) application of a voltage to the electron emission section, the (c) application of a voltage to the developer carriage section, and the (d) beginning of the carriage of the developer by the developer carriage section, at predetermined timings, respectively, so as to carry out stopping operation of the development device, the stopping operation being carried out together with final operation in the image forming device, which is required to be carried out before setting the image forming device to be back in a standby state.

35. The image forming device as set forth in claim 34, wherein:

the control section stops the (d) beginning of the carriage of the developer by the developer carriage section, the (c) application of a voltage to the developer carriage section, the (b) application of a voltage to the electron emission section, and the (a) application of a voltage to the irradiation section, in this order so as to carry out the stopping operation.

36. The image forming device as set forth in claim 34, wherein:

the final operation includes removal of a residual voltage of the latent image holding body, detection of presence or absence of the recording medium on the carriage section, and removal of the developer remaining on the latent image holding body.

* * * * *